US006805438B2

(12) United States Patent
Kaga et al.

(10) Patent No.: US 6,805,438 B2
(45) Date of Patent: Oct. 19, 2004

(54) INK JET PRINTER

(75) Inventors: Hikaru Kaga, Ama-gun (JP); Seiji Shimizu, Ogaki (JP); Tsuyoshi Suzuki, Owariasahi (JP); Katsunori Nishida, Nagoya (JP); Takamasa Usui, Oagaki (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/984,470

(22) Filed: Oct. 30, 2001

(65) Prior Publication Data

US 2002/0071015 A1 Jun. 13, 2002

(30) Foreign Application Priority Data

Dec. 7, 2000 (JP) ..... 2000-372688

(51) Int. Cl.[7] ..... B41J 2/17
(52) U.S. Cl. ..... 347/94
(58) Field of Search ..... 347/94, 92, 85, 347/86, 87

(56) References Cited

U.S. PATENT DOCUMENTS 4,347,524 A * 8/1982 Engel et al. ..... 347/94
5,030,973 A * 7/1991 Nonoyama et al. ..... 347/93

FOREIGN PATENT DOCUMENTS

JP A 59-73953 4/1984
JP B2 2887605 2/1999

* cited by examiner

*Primary Examiner*—Michael Nghiem
(74) *Attorney, Agent, or Firm*—Oliff & Berridge, PLC

(57) ABSTRACT

An ink jet printer uses an ink tank storing ink to be supplied to a print head, an ink tube, an ink chamber mounted on a carriage to store ink to be supplied from the ink tank to the print head, and a connecting member that includes an ink outflow port connected to the ink chamber and an ink inflow port where ink flows from the ink tube. At an intersection of the ink inflow port and the ink outflow port, a direction of a flow of ink from the ink inflow port is changed. Further at the intersection, a cushion is provided to absorb pressure waves generated in the ink tube on an extended line in an initial direction where ink flows in the ink passage over the intersection.

34 Claims, 5 Drawing Sheets

INK JET PRINTER

BACKGROUND OF THE INVENTION

1. Field of Invention

The invention relates to an ink jet printer that performs printing by ejecting ink from a print head, and particularly to an ink jet printer of an ink tube supply type where ink is supplied from an ink tank storing ink to be ejected to a print head through ink supply tubes.

2. Description of Related Art

As a conventionally known ink jet printer of ink tube supply type, there is an ink jet printer disclosed in Japanese Laid-Open Patent Publication No. 59-73953.

This ink jet printer designated by the numeral 20 is shown in FIG. 5. FIG. 5 is a perspective view showing the ink jet printer 20 in schematic form. The ink jet printer 20 includes a print head unit 21, a platen roller 22, a carriage 23, an ink tank 24, an ink tube 25, a signal input line 26, and guide rods 27.

The print head unit 21 is equipped with a print head having ink nozzles from which ink is ejected to perform printing onto a paper sheet based on a signal sent via the signal input line 26. The print head unit 21 receives a supply of ink from the ink tank 24 via the ink tube 25. The print head unit 21 is installed on the carriage 23, which is attached to a belt. The belt is looped around a roller attached to a motor. Thus, when the motor runs, the belt is driven, which allows the carriage 23 with the print head unit 21 to move for whatever distance the belt is driven.

The guide rods 27 are slidably inserted into the carriage 23 and support the carriage 23 for movement. Thus, the print head unit 21 installed on the carriage 23 can reciprocate in a direction parallel to the guide rods 27, that is, in the direction of the length of the platen roller 22.

In the ink jet printer of tube supply type, when the carriage equipped with the print head performs a printing operation while moving reciprocally, the ink in the ink tube undergoes acceleration, causing pressure waves that propagate in the ink toward the print head. The above-described printer is structured to absorb the pressure waves generated in the ink by placing an air-filled damper between the tubes.

On the other hand, to hold printing quality in condition, the ink jet printer needs to maintain a constant state of ink to be ejected from the ink nozzles. To maintain the state of ink to be ejected, a meniscus (curved surface) is formed on the surface of the ink at the end of each of the ink nozzles. As the meniscus is formed by, for example, causing a negative pressure in the ink to be supplied to the nozzles within a specified range, the pressure to supply the ink is kept constant, always producing the meniscus with the same shape. Thus, the ink to be ejected is maintained under a certain condition.

However, when the pressure waves propagating toward the print head are generated in the ink due to acceleration imported to the ink, the negative pressure applied to the nozzles is changed and the meniscuses are destroyed. Therefore, the ink to be ejected can not be maintained under a constant condition, affecting printing quality.

SUMMARY OF THE INVENTION

The invention provides an ink jet printer that can efficiently absorb pressure waves generated in ink passages during printing.

Considering the foregoing, one aspect of the invention involves an ink jet printer that includes a print head that performs printing on a recording medium by ejecting ink from an ink nozzle; a carriage on which the print head is mounted that moves along the recording medium; an ink tank that is provided separately from the carriage and stores ink to be supplied to the print head; an ink tube that is connected to the ink tank to supply ink from the ink tank; an ink chamber that is mounted on the carriage and connected to the print head to store ink supplied from the ink tank; and a connecting member that is connected to the ink tube and the ink chamber to supply ink supplied from the ink tank to the ink chamber, wherein the connecting member includes a passage to change a direction of flow of the ink supplied from the ink tube and a cushion to absorb pressure waves generated in the ink.

According to another aspect of the invention, the ink jet includes a print head that performs printing to a recording medium by ejecting ink from an ink nozzle; a carriage on which the print head is mounted that moves along the recording medium; an ink tank that is provided separately from the carriage and stores ink to be supplied to the print head; an ink tube that is connected to the ink tank to supply ink from the ink tank; an ink chamber that is mounted on the carriage and connected to the print head to store ink supplied from the ink tank; and a connecting member that includes an ink inflow port connected to the ink tube to take ink supplied from the ink tank and an ink outflow port connected to the ink chamber, wherein a cushion is provided at an extremity extending from an intersection of the ink inflow port and the ink outflow port in a direction the ink flows from the ink inflow port.

BRIEF DESCRIPTION OF THE DRAWINGS

The invention will be described in greater detail with reference to embodiments thereof and the accompanying drawings wherein.

DETAILED DESCRIPTION OF THE EMBODIMENTS

Figure 1:
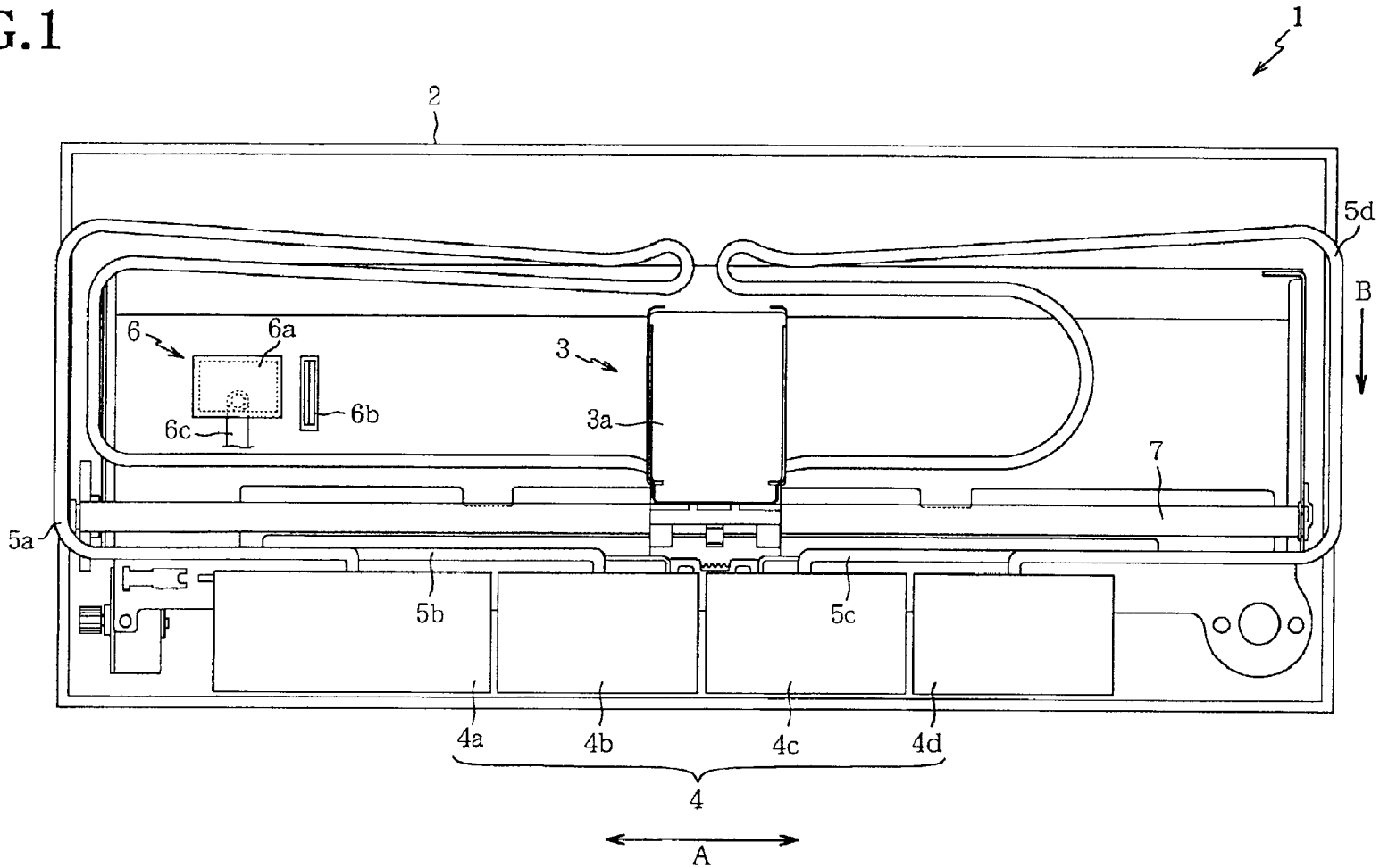
FIG. 1 is a developed side view of an ink jet printer according to one embodiment of the invention.

FIG. 1 is a side view of an ink jet printer 1 according to a first embodiment of the invention. The ink jet printer 1 includes a printer body 2 of flame-retardant plastic in substantially a box shape, a print head unit 3, ink tanks 4*a* to 4*d*, tubes 5*a* to 5*d* respectively connecting the print head unit 3 and the ink tanks 4*a* to 4*d*, a purge device 6, and guide rods 7.

The print head unit 3 is equipped with a plurality of print heads each of which ejects ink onto a paper sheet for printing. The print head unit 3 is in fluid communication with the ink tanks 4*a* to 4*d* storing ink provided at a lower part of the printer body 2 via the tubes 5*a* to 5*d* and a connector 9 (FIGS. 2–4), and receives ink from the ink tanks 4*a* to 4*d*. The print head unit 3 is installed on the carriage 3*a*, which is attached to a belt (not shown). The belt is looped around a roller (not shown) attached to a motor (not shown). When the motor runs, the belt is driven, which allows the carriage 3*a* with the print head unit 3 to move for a distance the belt is driven.

The print heads (not shown) are placed on the rear of the carriage 3*a* shown in FIG. 1, each including ink nozzles from which the ink is ejected toward a paper sheet for printing. In detail, an ink chamber pattern containing the ink to be ejected from the nozzles is provided to the rear of the ink nozzles. Actuators of piezoelectric elements are disposed in each ink chamber in the ink chamber pattern. When a signal is sent to the piezoelectric elements via a control circuit, which will be described later, the piezoelectric elements deform to apply a pressure to the ink in the ink chamber, and the ink is ejected from the ink nozzles. Because the condition of the ejected ink depends on the condition of the ink at the nozzles before being ejected, the ink needs to be kept in a certain state. The ink tank 4 is disposed below the print head unit 3 and a negative pressure is applied to the ink before being ejected, so that the surface of ink, i.e. the meniscus, at the end of each ink nozzle is convavely shaped.

The guide rods 7 are slidably inserted into the carriage 3*a* to support the carriage 3*a* so that it can move in a direction (A) orthogonal to a sheet feed direction. Thus, the print head unit 3 on the carriage 3*a* can move reciprocally in a direction parallel to the guide rods 7, that is, in the direction (A) of the length of the printer body 2.

The ink tank 4 is designed to store ink supplied to the print head unit 3, and disposed below the print head unit 3. The ink tank 4 comprises a number of sub-ink tanks, in this example, four ink tanks 4*a* to 4*d* storing black, yellow, cyan, and magenta ink in the identified order from left to right as shown in FIG. 1. One end of each of the tubes 5*a*–5*d* is attached to the corresponding ink tank 4*a*–4*d* so as to supply the respective color inks of black, yellow, cyan and magenta to the print head unit 3. The other end of each of the tubes 5*a*–5*d* is connected to a print head for the respective color ink. Each of color inks is ejected from the print heads, enabling full-color printing on a paper sheet.

The purge device 6 that performs the purging operation is disposed on a left end of the printer body 2. The purging operation is a process to recover the state of the ink to be ejected from the print head. The purging device 6 is provided with a suction cap 6*a* that can hermetically seal the ink nozzles of the print heads, a wiper 6*b* that wipes the surface of the ink nozzles, and a pump (not shown) that sucks ink from the suction cap 6*a* via a discharge tube 6*c*. The purging device 6 may be designed to discharge the ink from the print head by applying a positive pressure to the ink from the ink tank 4.

During the purging operation, the motor is driven to move the print head unit 3, equipped with the print heads, to the left of the ink jet printer 1 as shown as shown in FIG. 1, and the ink nozzles of the print heads are hermetically sealed by the suction cap 6*a*. Then, the pump is actuated, and air bubbles and solidified ink are sucked and discharged from the tube 6*c*. The surface of the print head is wiped by the wiper 6*b*, so that the state of the ink nozzles is recovered. A control circuit board (not shown) mounting a CPU, a ROM, a RAM and other devices, for control, are provided inside the printer body 2. The control circuit board controls the ink jet printer 1 according to control programs related to operation of the ink jet printer 1. The purging operation in the purge device 6 is also controlled by the control circuit board.

Figure 2:
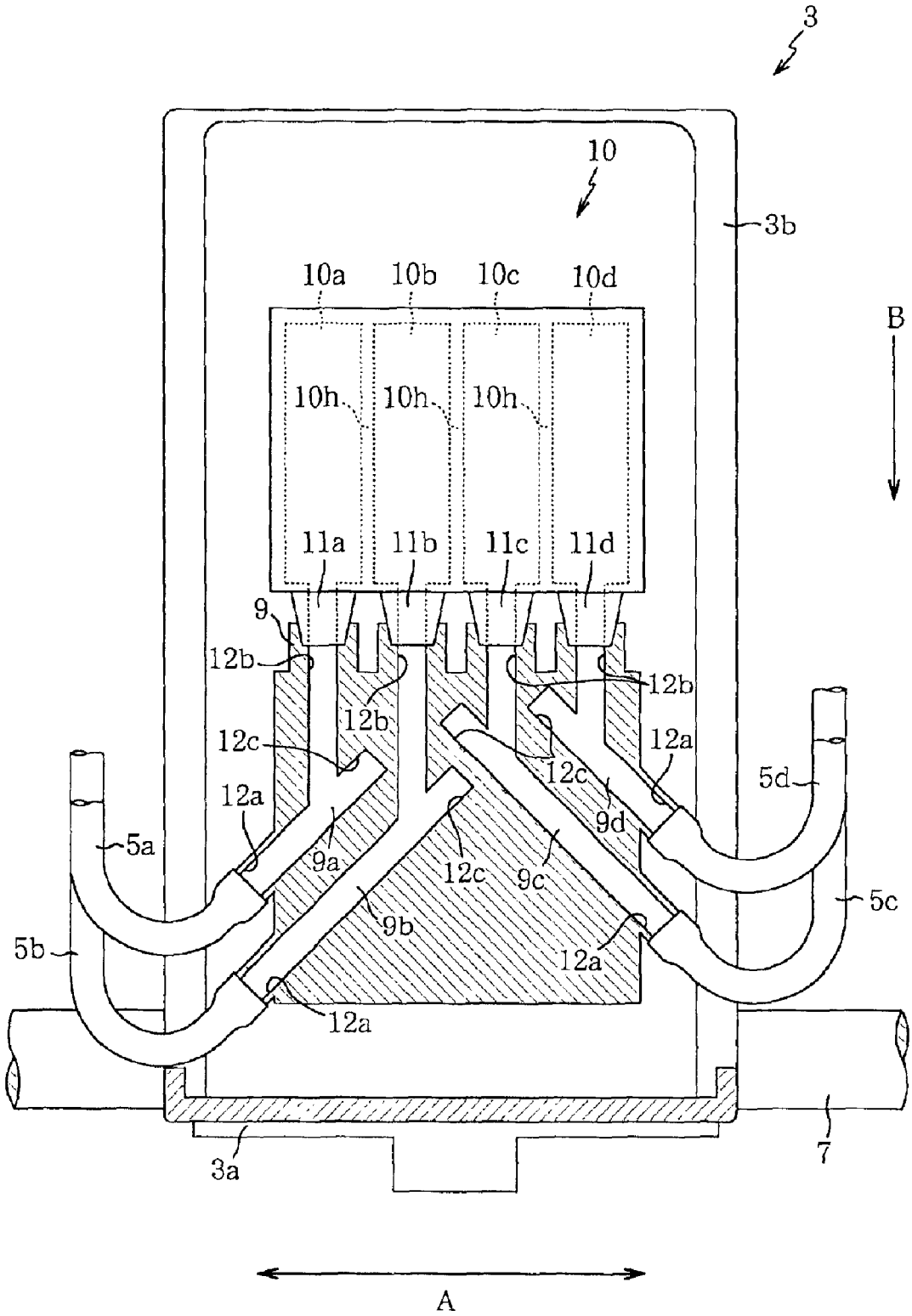
FIG. 2 is a sectional view of a print head unit of the invention.

The connector 9 will be described in detail with reference to FIGS. 2 and 3. FIG. 2 is an enlarged sectional view of the connector 9 of the print head unit 3.

The carriage 3*a* is provided with a case 3*b* accommodating ink chambers 10*a*–10*d* and the connector 9. The ink chambers 10*a*–10*d* are divided by partitions 10*h* so that each chamber, containing a different color ink, is linked to a print head of the corresponding color. The ink chambers 10*a*–10*d* are provided with intakes 11*a*–11*d* at the bottom, each of which connects the connector 9 and an appropriate one of the ink chambers 10*a*–10*d*. The ink chambers 10*a*–10*d* are designed to catch air bubbles included in the ink supplied from the ink tanks 4*a*–4*d* and prevent such air bubbles from flowing into the print heads.

The connector 9 is a structural component to connect tubes 5*a*–5*d*, each supplying ink from a corresponding ink tank 4*a*–4*d* and the ink chambers 10*a*–10*d*, and is formed into one body by injection molding. The connector 9 is provided with four ink passages 9*a*–9*d* corresponding to the tubes 5*a*–5*d*. Each of the ink passages 9*a*–9*d* includes an ink inflow port 12*a* into which the ink supplied from the corresponding tank 4*a*–4*d*, of the ink tank 4, flows and an ink outflow port 12*b* connected to each of the intakes 11*a*–11*d* The ink inflow port 12*a* extends straightly from a connecting point with the tube 5*a*–5*d* The ink outflow port 12*b* extends straightly from a connecting point with the intake 11*a*–11*d*. The ink inflow port 12*a* and the ink outflow port 12*b*, of each ink passage 9*a*–9*d*, are disposed so as to intersect with each other. An air chamber 12*c*, of which an upper end is blocked, extends from an intersection of the ink inflow port 12*a* and the ink outflow port 12*b*. The ink inflow port 12*a* and the ink outflow port 12*b* of the ink passages 9*a*–9*d* function to change the direction of ink flow, and the air chamber 12*c* serves as a cushion. The air chamber 12*c* is formed at a stage where the connector 9 is made by injection-molding. The air chamber 12*c* is filled with air, which absorbs the pressure waves generated in the ink passage.

The air chamber 12*c* extends from the intersection of the ink inflow port 12*a* and the ink outflow port 12*b*, so as to prevent air from flowing toward the print head along with the ink flow. Thus, the air in the air chamber 12*c* can be maintained easily and continuously, and the pressure waves generated in the ink inflow port 12*a* can be appropriately absorbed.

Further, the air chamber 12*c* is structured so that a certain amount of air remains even during the purging operation performed by the purge device 6.

Figure 3:
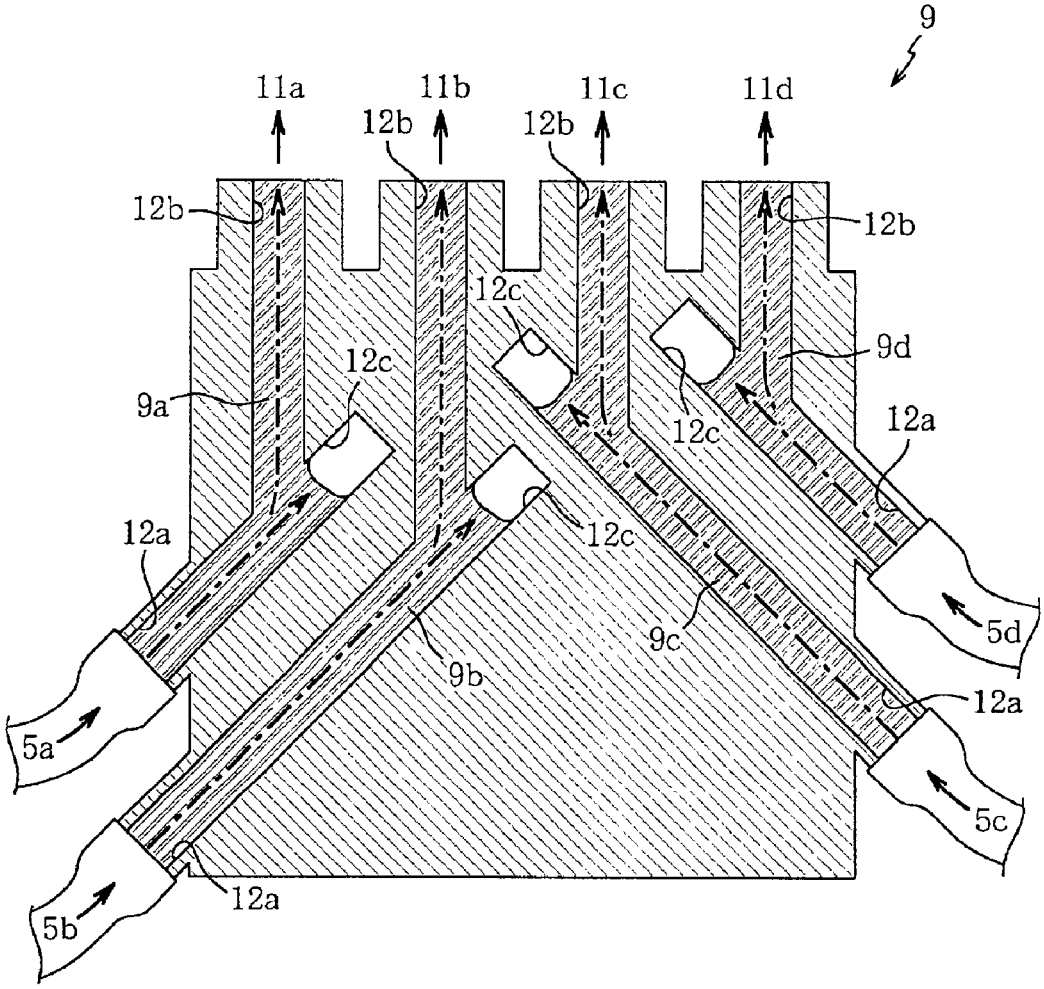
FIG. 3 is a sectional view of a connecting member of the invention.

Referring to FIG. 3, an ink flow and propagation of the pressure waves in the connector 9 will be described. FIG. 3 is an enlarged sectional view of the connector 9 in schematic showing an ink flow and propagation of the pressure waves. As the ink flows, the inks supplied from the ink tank 4 via tubes 5*a*–5*d* flow from the corresponding ink inflow port 12*a* of the connector 9 and each ink flow comes into collision with the air remaining in the corresponding air chamber 12*c* provided at an extremity in the direction of ink flow the ink inflow port 12*a*. When the ink collides against the trapped air, the direction of ink flow changes, the ink flows to the ink outflow port 12*b* and the appropriate ink chamber 10*a*–10*d*, and is supplied to the print head.

The pressure waves generated in the ink tubes 5*a*–5*d* because of the acceleration of the carriage 3*a* propagate to the ink inflow port 12*a* of the connector 9. The pressure waves traveling through the ink inflow port 12*a* strike the air remaining in the air chamber 12*c*, are absorbed and, this, not transmitted to the ink outflow port 12*b* and the print head.

As described above, according to the ink jet printer 1 in the first embodiment, the air chambers 12*c* are provided in the connector 9. As each air chamber 12*c* absorbs the pressure waves generated in the corresponding ink tube 5*a*–5*d*, the meniscuses are maintained at the ink nozzles. Therefore, printing irregularities incident to the acceleration of the carriage can be prevented and printing quality can be improved.

Figure 4:
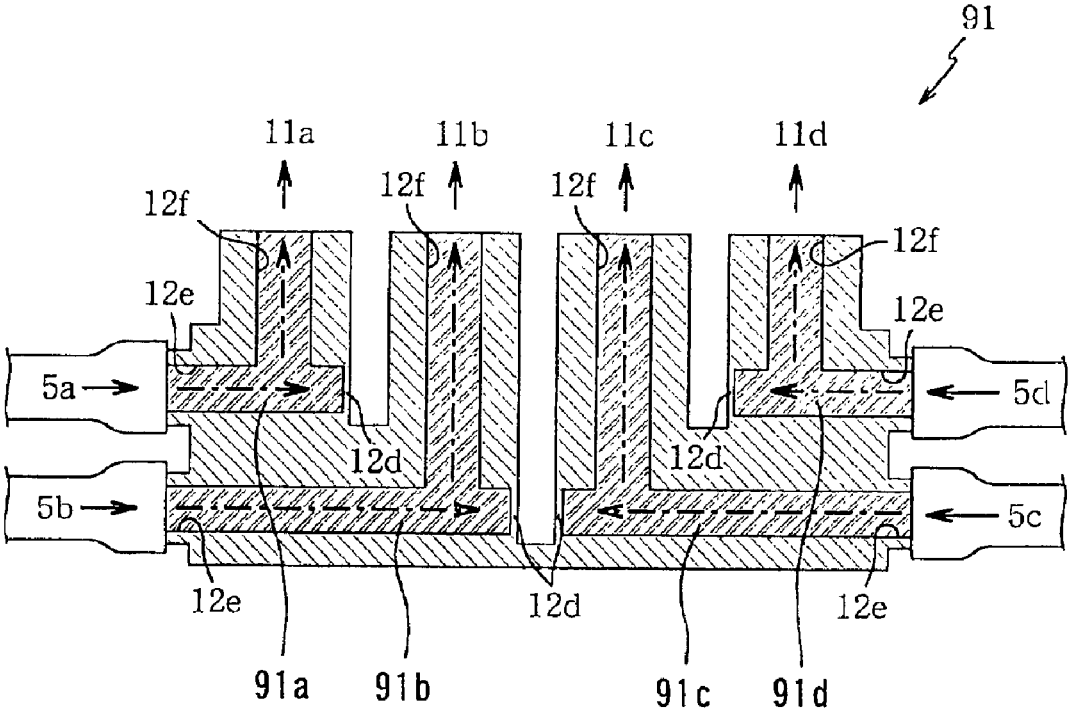
FIG. 4 is a sectional view of a connecting member according to another embodiment of the invention.
Figure 5:
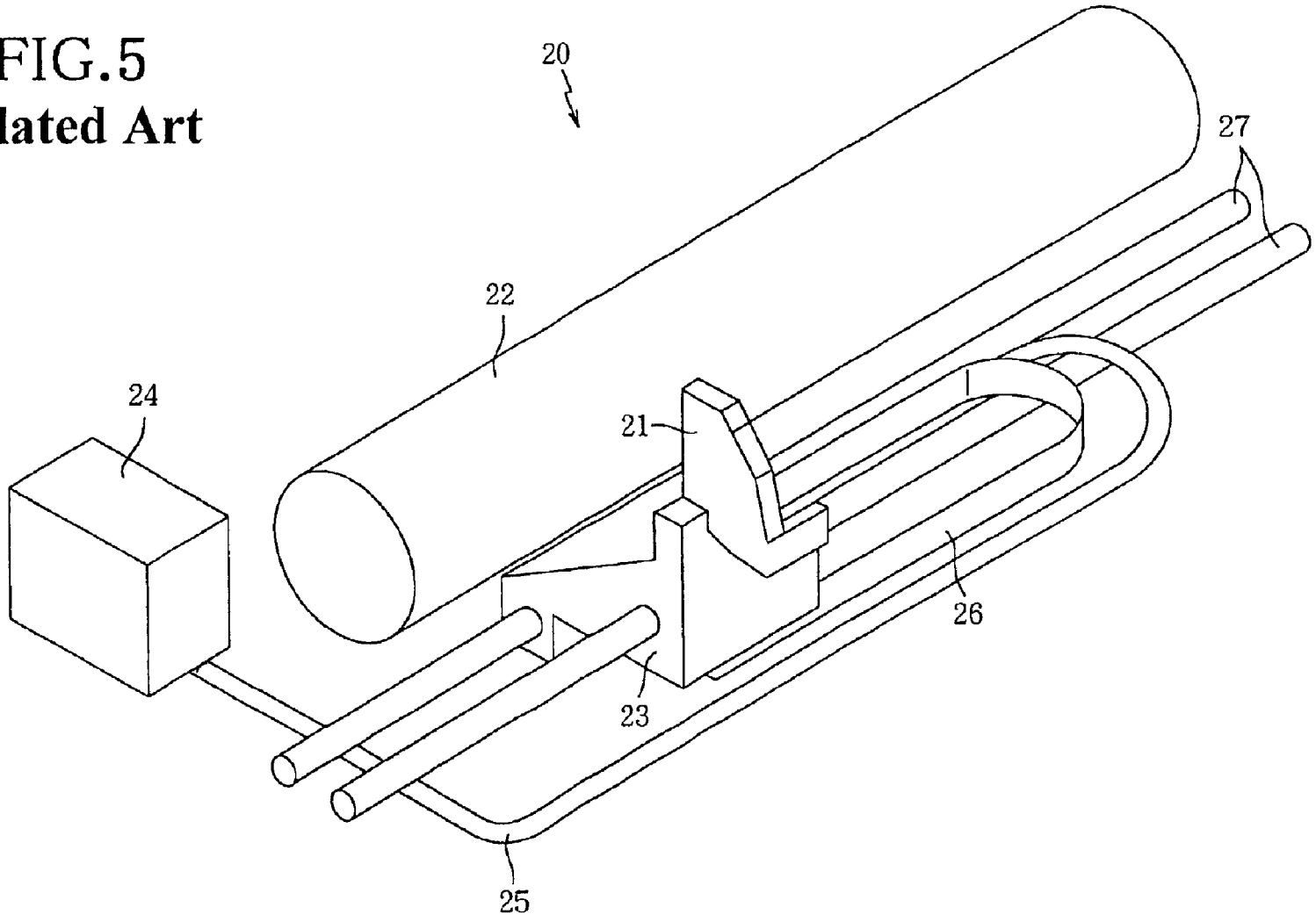
FIG.5 Related Art
FIG. 5 is a perspective view of a conventional ink jet printer.

Referring to FIG. 4, a second embodiment of the invention will be described.

In the ink jet printer 1 of the second embodiment, a thin wall 12*d* is formed at an extremity of an ink inflow port 12*e* projecting from an intersection of the ink inflow port 12*e* and an ink outflow port 12*f* in the ink flow direction. Hereinafter, parts already described in the first embodiment are designated by the same numerals to omit the description thereof for simplicity. Only different parts will be described below.

FIG. 4 is an enlarged sectional view of a connector 91 in schematic form showing an ink flow and propagation of the pressure waves. The connector 91 is a structural component to connect the tubes 5*a*–5*d*, each supplying ink from the corresponding sub-ink tank 4*a*–4*d* of the ink tank 4, with the ink chambers 10*a*–10*d*, and is formed into one body by injection molding. Each of ink passages 91*a*–91*d* in the connector 91 includes an ink inflow port 12*e*, into which ink to be supplied from one of the tubes 5*a*–5*d* flows, and an ink outflow port 12*f*, which is connected to an intake 11*a*–11*d* of an ink chamber 10*a*–10*d*. In the connector 91, each ink inflow port 12*e* and a corresponding ink outflow port 12*f* are disposed so as to intersect each other. The extremity of the ink inflow port 12*e* is closed with the thin wall 12*d*. The thin wall 12*d* is formed while the connector 9 is made by injection-molding, and structured in such a manner to create a thin wall between an outer wall of the connector 91 and the extremity of the ink inflow port 12*e*. The ink inflow port 12*e* and the ink outflow port 12*f* of the connector 9 function to change the ink flow direction.

The thin wall 12*d* functions as a cushion. The thin wall 12*d* is formed of an elastic member (e.g. elastomer) so as to vibrate. Thus, when the pressure waves generated in the ink passages (the tubes 5*a*–5*d*) are propagated and collide with the associated thin wall 12*d*, the thin wall 12*d* vibrates due to its elasticity. The vibration of the thin wall 12*d* loosens the pressure waves, so that the pressure can be absorbed.

As the thin wall 12*d* provided in the connector 91 absorbs the pressure waves generated in the ink tubes 5*a*–5*d*, the meniscuses are maintained at the ink nozzles. Therefore, printing irregularities incident to the acceleration of the carriage can be prevented and printing quality can be improved.

The connector 91 is made of an elastic member. The elastic member can be easily deformed through the application of stress and absorbs the applied stress. Therefore, the thin wall 12*d* made of the elastic member can efficiently absorb the pressure waves generated in the ink passages.

As described, the connector 91 is made as one body. Accordingly, the manufacturing procedure of the connector 91 can be simplified, resulting in improvement in productivity. However, a connector could be made for each ink tank and the plurality of connectors assembled to create a connector assembly.

It should be understood that the invention is not limited in its application to the details of structure and arrangement of parts illustrated in the accompanying drawings. The invention is capable of other embodiments and of being practiced or performed in various ways without departing from the technical idea thereof, based on existing and well-known techniques among those skilled in the art. For example, the upper wall of the air chamber 12*c* in the first embodiment can be formed thinly as in the second embodiment, so as to absorb the pressure waves by concurrent use of air and the thin wall.

What is claimed is:

1. An ink jet printer, comprising:

a print head that performs by ejecting ink;

a carriage on which the print head is mounted;

an ink tank that is provided separately from the carriage and stores the ink to be supplied to the print head;

an ink tube that is connected to the ink tank to supply the ink from the ink tank;

an ink chamber that is mounted on the carriage and connected to the print head to store the ink supplied from the ink tank; and a one-piece connecting member that is connected to the ink tube and the ink chamber to supply ink supplied from the ink tank to the ink chamber, wherein the connecting member includes a continuous passage that changes a direction of a flow of the ink supplied from the ink tube and a cushion to absorb pressure waves generated in ink, the passage including an ink inflow port which is connected to the ink tube and an ink outflow port which is connected to the ink chamber and formed in such a manner that the ink inflow port and the ink outflow port intersect each other, the ink inflow port straightly extends in a single direction, and the cushion is provided at an extremity extending from an intersection of the ink inflow port and the ink outflow port in a direction of ink flow from the ink tube to the ink inflow port.

2. The ink jet printer according to claim 1, wherein the cushion is an air chamber.

3. The ink jet printer according to claim 2, wherein the ink chamber is disposed at an upper part of the connecting member, the ink tube is disposed at a lower part of the connecting member and the air chamber is provided extending from the intersection of the ink inflow port and the ink outflow port.

4. The ink jet printer according to claim 1, wherein the cushion is formed into a thin wall.

5. The ink jet printer according to claim 4, wherein the thin wall is made of an elastic member.

6. The ink jet printer according to claim 1, wherein the ink outflow port straightly extends in a single direction.

7. The ink jet printer according to claim 6, wherein the extremity has a first end that is open and adjacent to the intersection, a second end that is closed and opposite the first end, and the cushion continuously remains between the ink and the second end.

8. An ink jet printer, comprising:

a print head that performs printing by ejecting ink;

a carriage on which the print head is mounted;

an ink tank that is provided separately from the carriage and stores the ink to be supplied to the print head;

an ink tube that is connected to the ink tank to supply the ink from the ink tank;

an ink chamber that is mounted on the carriage and connected to the print head to store the ink supplied from the ink tank; and a one-piece connecting member that includes an ink inflow port connected to the ink tube to take the ink supplied from the ink tank and an ink outflow port connected to the ink chamber and a continuous passage therebetween that changes a direction of ink flow, wherein the ink inflow port straightly extends in a single direction, and a cushion is provided at an extremity extending from an intersection of the ink inflow port and the ink outflow port in a direction ink flows from the ink inflow port.

9. The ink jet printer according to claim 8, wherein the cushion is an air chamber.

10. The ink jet printer according to claim 9, wherein the air chamber is provided extending from the intersection of the ink inflow port and the ink outflow port.

11. The ink jet printer according to claim 8, wherein the cushion is formed into a thin wall.

12. The ink jet printer according to claim 11, wherein the thin wall is made of an elastic material.

13. The ink jet printer according to claim 12, wherein the connecting member is made as one body.

14. The ink jet printer according to claim 8, wherein the ink outflow port straightly extends in a single direction.

15. The ink jet printer according to claim 14, wherein the extremity has a first end that is open and adjacent to the intersection, a second end that is closed and opposite the first end, and the cushion continuously remains between the ink and the second end.

16. A connection device in a fluid flow path, comprising a one piece body;

at least one inflow port in the body;

at least one outflow port in the body;

at least one fluid flow passage through the body between the at least one inflow port and the at least one outflow port, and a pressure absorption mechanism positioned in the at least one fluid flow passage, wherein there are four inflow port, outflow port, and fluid flow passage with pressure absorption mechanism combinations.

17. A connection device in a fluid flow path, comprising:

a one piece body;

at least one inflow port in the body;

at least one outflow port in the body;

at least one fluid flow passage through the body between the at least one inflow port and the at least one outflow port, and a pressure absorption mechanism positioned in the at least one fluid flow passage, wherein the at least one fluid flow passage includes a first portion leading from the at least one inflow port and a second portion leading to the at least one outflow port, the pressure absorption mechanism is at the junction of the first portion and the second portion, and the pressure absorption mechanism comprises a fluid chamber having a thin wall, the fluid chamber formed as an extension of the first portion, the first portion and the second portion joined at a right angle.

18. An ink jet printer, comprising:

a print head that performs printing by ejecting ink;

a carriage on which the print head is mounted;

an ink tank that is provided separately from the carriage and stores the ink to be supplied to the print head;

an ink tube that is connected to the ink tank to supply the ink from the ink tank;

an ink chamber that is mounted on the carriage and connected to the print head to store the ink supplied from the ink tank; and a connecting member that is connected to the ink tube and the ink chamber to supply the ink supplied from the ink tank to the ink chamber, wherein the connecting member includes a continuous passage that changes a direction of a flow of the ink supplied from the ink tube and a cushion to absorb pressure waves generated in the ink, the continuous passage includes an ink inflow port which is connected to the ink tube and an ink outflow port which is connected to the ink chamber, the ink inflow port straightly extends in a single direction, the cushion is provided at an extremity of the inflow port, and the ink outflow port is connected to the ink inflow port before the cushion.

19. The ink jet printer according to claim 18, wherein the continuous passage is formed in such a manner that the ink inflow port and the ink outflow port intersect each other.

20. The ink jet printer according to claim 19, wherein the cushion is provided at an extremity extending from an intersection of the ink inflow port and the ink outflow port in a direction of ink flow from the ink tube to the ink inflow port.

21. The ink jet printer according to claim 20, wherein the cushion is an air chamber.

22. The ink jet printer according to claim 21, wherein the ink chamber is disposed at an upper part of the connecting member, the ink tube is disposed at a lower part of the connecting member and the air chamber is provided extending from the intersection of the ink inflow port and the ink outflow port.

23. The ink jet printer according to claim 20, wherein the cushion is formed into a thin wall.

24. The ink jet printer according to claim 23, wherein the thin wall is made of an elastic member.

25. The ink jet printer according to claim 18, wherein the ink outflow port straightly extends in a single direction.

26. The ink jet printer according to claim 25, wherein the extremity has a first end that is open and adjacent to the intersection, a second end that is closed and opposite the first end, and the cushion continuously remains between the ink and the second end.

27. An ink jet printer, comprising:

a print head that performs printing by ejecting ink;

a carriage on which the print head is mounted;

an ink tank that is provided separately from the carriage and stores the ink to be supplied to the print head;

an ink tube that is connected to the ink tank to supply the ink from the ink tank;

an ink chamber that is mounted on the carriage and connected to the print head to store the ink supplied from the ink tank; and a connecting member that includes an ink inflow port connected to the ink tube to take the ink supplied from the ink tank and an ink outflow port connected to the ink chamber and a continuous passage therebetween that changes a direction of ink flow, wherein the ink inflow port straightly extends in a single direction, a cushion is provided at an extremity extending from an intersection of the straightly extending ink inflow port and the ink outflow port, and is an extension to the ink inflow port, and the ink outflow port is connected to the ink inflow port before the cushion.

28. The ink jet printer according to claim 27, wherein the cushion is an air chamber.

29. The ink jet printer according to claim 28, wherein the air chamber is provided extending from the intersection of the ink inflow port and the ink outflow port.

30. The ink jet printer according to claim 27, wherein the cushion is formed into a thin wall.

31. The ink jet printer according to claim 31, wherein the thin wall is made of an elastic material.

32. The ink jet printer according to claim 31, wherein the connecting member is made as one body.

33. The ink jet printer according to claim 27, wherein the ink outflow port straightly extends in a single direction.

34. The ink jet printer according to claim 33, wherein the extremity has a first end that is open and adjacent to the intersection, a second end that is closed and opposite the first end, and the cushion continuously remains between the ink and the second end.

* * * * *